United States Patent [19]

Vareide et al.

[11] 4,243,380

[45] Jan. 6, 1981

[54] METHOD AND DEVICE FOR DISTRIBUTING LIQUID FUEL TO A FLUIDIZED BED

[76] Inventors: Dag Vareide, Nedre Mollenberggate 83; Odd E. Solheim, Chatarina Lysholms vei 6B, both of N-7000 Trondheim, Norway

[21] Appl. No.: 12,748

[22] Filed: Feb. 16, 1979

[30] Foreign Application Priority Data

Feb. 17, 1978 [NO] Norway ..... 780549

[51] Int. Cl.[3] ..... F27B 15/00

[52] U.S. Cl. ..... 432/15; 239/138; 431/239

[58] Field of Search ..... 432/14, 15, 58; 34/57 A; 110/245; 431/239; 239/138

[56] References Cited

U.S. PATENT DOCUMENTS

| | | | |
|---|---|---|---|
| 1,299,843 | 4/1919 | Long | 239/138 |
| 2,315,482 | 3/1943 | Fortis | 431/239 |
| 3,139,138 | 6/1964 | Bloom | 431/239 |
| 3,737,283 | 6/1973 | Nikles | 432/58 |
| 3,799,747 | 3/1974 | Schmalfeld et al. | 432/58 |
| 3,804,581 | 4/1974 | Schmalfeld et al. | 432/58 |
| 3,861,862 | 1/1975 | Steever et al. | 432/58 |
| 4,073,064 | 2/1978 | Steever et al. | 432/58 |
| 4,165,040 | 8/1979 | Beacham et al. | 432/15 |

*Primary Examiner*—Henry C. Yuen

*Attorney, Agent, or Firm*—Finnegan, Henderson, Farabow, Garrett & Dunner

[57] ABSTRACT

Liquid fuel is distributed in a fluidized bed of refractory particles through the gas constriction plate of a fluidized bed incinerator. The fuel is supplied from a distribution system of circulation pipes situated well below the constriction plate and passed to the fluidized bed through risers by means of a small amount of driving agent, preferably steam, of high pressure supplied from a separate distribution system independently of the primary combustion air and the fluidizing gas. The driving agent and the fuel are passed into the risers through nozzles at the lower end of the risers.

2 Claims, 3 Drawing Figures

METHOD AND DEVICE FOR DISTRIBUTING LIQUID FUEL TO A FLUIDIZED BED

BACKGROUND OF THE INVENTION

1. Field of the Invention

The present invention relates to a method and a device for distributing liquid fuel in a fluidized bed from below through substantially vertical risers extending through a constriction plate for the supply of fluidizing and primary air, the fuel being carried up through the risers by a gaseous driving agent and out through distribution openings.

Certain difficulties have been encountered in the supply of oil and other liquid fuels to incinerators employing fluidized beds, because there is a tendency for distribution or supply openings or atomization nozzles to be blocked by carbonization and sintering of the fuel. Also it has been found difficult to distribute the fuel uniformly over the entire fluidized bed.

2. Description of the Prior Art

These problems are solved, at least in part, by an oil supply system which is described in CA-PS 987,100. In this system a double constriction plate is employed, so that between the upper and the lower walls of the constriction plate an oil supply chamber is formed which communicates with each of the tuyeres supplying fluidizing and primary air to the fluidized bed of the incinerator. Each tuyere is of relatively large cross section to allow the passage of the required quantity of fluidizing air, and transportation of oil up through the tuyeres is stated to take place along the internal walls of the tuyeres, on which is formed an oil film which "climbs" up the tuyeres due to the flow of air.

However, a disadvantage of the system shown in CA-PS 987,100 is that the double constriction plate with tuyeres constitutes a complicated structure which is not easily accessible for maintenance. This is especially true for the apertures between the oil chamber in the constriction plate and the tuyeres, which may easily be blocked. Furthermore, it is a disadvantage that rapid cutting off of the fuel supply can only be achieved by cutting off the supply of fluidizing air, so that fluidizing cannot be maintained after the fuel supply has been cut off.

According to US-PS 4,021,193 the fuel may be distributed in the fluidizing air through separate nozzles immediately ahead of the opening through which the fluidizing air is introduced in the bed. This allows the fuel supply to be cut off while continuing the supply of fluidizing air. However, the nozzles through which the fuel is introduced in the fluidizing air passage, are adjacent the combustion bed. This fact as well as the fact that the pressure of the fluidizing air is low, as in the structure according to CA-PS 987,100, result in a tendency of the fuel to form deposits, eventually blocking the inlet openings for fuel and fluidizing air, at least in an ordinary fluidized bed as contrasted with a spouted fluidized bed with which the US-PS 4,021,193 is actually concerned.

SUMMARY OF THE INVENTION

One object of the invention is to provide a method and a device for distributing liquid fuel as uniformly as possible in the fluidized bed, avoiding the disadvantages associated with the systems disclosed in CA-PS 987,100 and US-PS 4,021,193.

The method according to the invention is characterized in that there is used a high pressure driving agent which is supplied in small quantities independently of the supply of primary air. Preferably, the fuel is supplied to the riser from a distribution system through constricted nozzles which are adapted to the required fuel supply. The same applies to the supply of driving agent, which is also supplied from a distribution system through separate, constricted nozzles.

By employing a separate gaseous driving agent, preferably high pressure steam, for injection of the oil, complete independence of the fuel supply and the fluidization is achieved. Whereas the fluidizing air is supplied in very large quantities at low pressure, the steam employed as a driving agent for the oil may be supplied at a pressure of e.g. 7 bar and in quantities of only a few percent of the fuel quantity and only parts per thousand of the amount of fluidizing air. As a result of the high pressure of the driving agent high velocities of the mixture of oil and driving agent in the risers and nozzles at the upper ends thereof are also achieved. This prevents the refractory particles of the fluidized bed from blocking these nozzles.

The device according to the invention is characterized in that besides nozzles or tuyeres for distributing fluidizing and primary air separate risers extend through the constriction plate, said risers communicating with a distribution system for fuel and a distribution system for a separate, gaseous high pressure driving agent. The fuel distribution system may preferably take the form of pipe loops, each having a fuel inlet and a fuel outlet. This allows the fuel to circulate in the pipe loops, obtaining a more uniform temperature and viscosity of the oil, so that the same quantity of oil is fed to all the risers. The fuel pipe loops may be located at a good distance from the constriction plate, so as not to be subjected to heavy thermal loads. This will increase their life and improve reliability, and at the same time the distribution system will be relatively easily accessible for maintenance.

BRIEF DESCRIPTION OF THE DRAWINGS

Further features and advantages of the invention will appear from the following description, reference being had to the drawing which illustrates an exemplary embodiment.

DESCRIPTION OF THE PREFERRED EMBODIMENT

Figure 2:
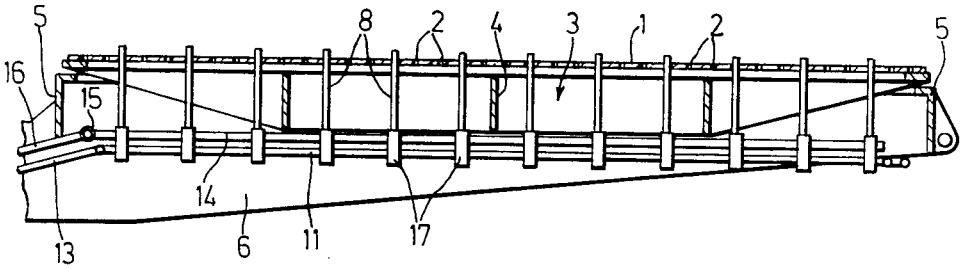
FIG. 2 is a cross section along the line II—II in FIG. 1.
Figure 1:
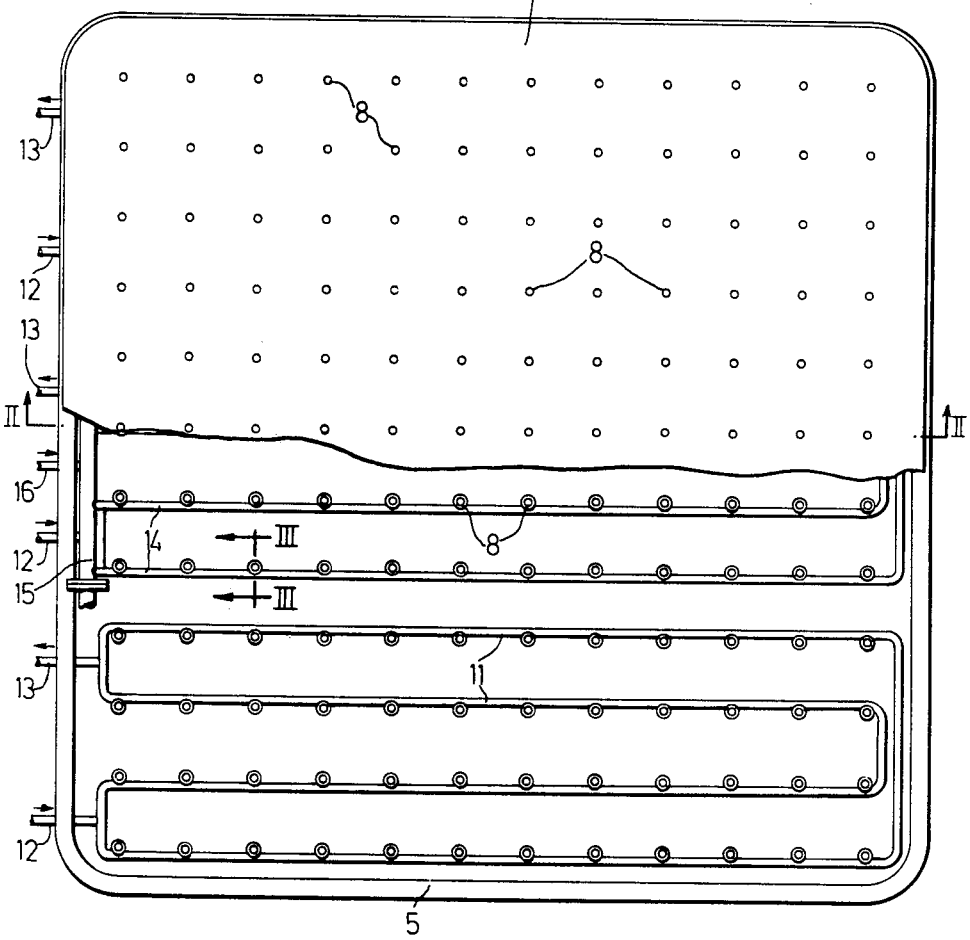
FIG. 1 is a diagrammatic plan view of a constriction plate for an incinerator operating with a fluidized bed, part of the constriction plate and its supporting frame being cut away to show the underlying fuel supply system according to the invention.

In FIGS. 1 and 2 there is shown a gas constriction plate 1 for the supply of fluidizing and primary air to an overlying bed of refractory particles, not shown, to which also oil fuel is supplied. The constriction plate 1 has a plurality of gas distribution apertures which are highly schematically indicated at 2 in FIG. 2, but which for the sake of simplicity are not shown in FIG. 1. The constriction plate 1 is supported on a supporting frame 3 having supporting webs 4, the frame 3 in turn being supported by a frame 5 having supporting arms 6, which are mounted in the upper part of the windbox positioned below the incinerator.

Besides the holes 2, the constriction plate 1 is provided with holes 7 (FIG. 3) through which risers 8 for the supply of fuel oil project. The risers 8 are supported by the constriction plate 1 by means of locking washers 9 having inwardly projecting tongues 10 which bite into the outer surfaces of the risers 8, and resting against the upper side of the constriction plate 1. The risers 8 communicate with two distribution pipe systems which are located under the constriction plate 1, and which may be fixed to the constriction plate 1, the supporting frame 3 and/or the frame 5 including the supporting arms 6. The undermost distribution pipe system serves to supply oil and consists of three closed pipe loops 11, each having an inlet 12 and an outlet 13 for oil, so that the oil can circulate continuously in the pipe loops 11. Immediately above the pipe loops 11 for oil there is a row of straight supply pipes 14 for driving agent. The pipes 14 are blind at the right hand end in FIG. 1, and at the opposite end they are connected to a manifold pipe 15 to which steam is supplied through a pipe 16.

Figure 3:
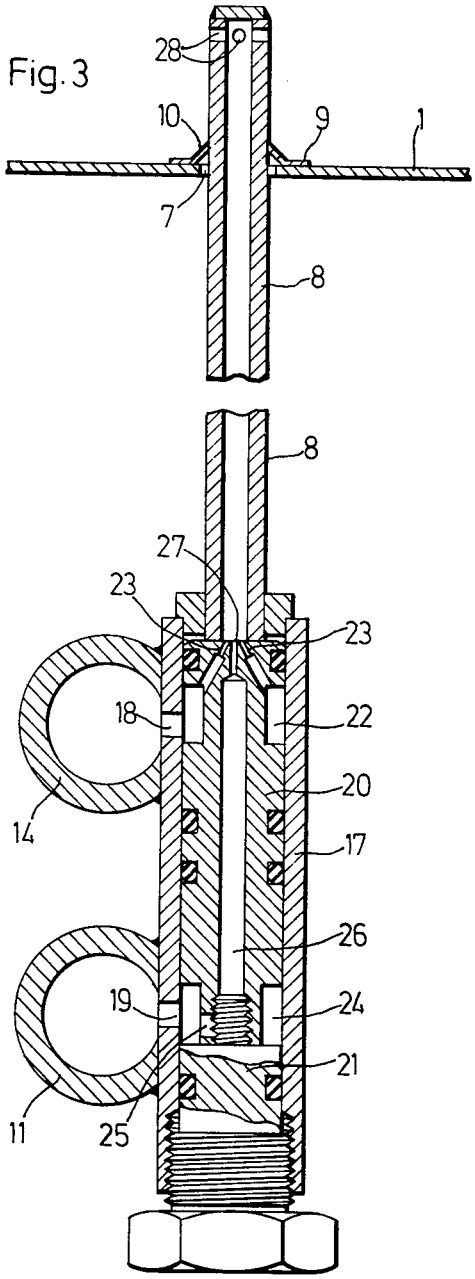
FIG. 3 is a cross section on a substantially larger scale along the line III—III in FIG. 1.

As seen in FIG. 3 each riser 8 has a lower, enlarged pipe position 17 which is welded to both of the two supply pipes 14 and 11 lying one above the other, and which communicates with these pipes through apertures 18 and 19 respectively. The pipe portion 17 is fitted with a replaceable nozzle member 20, which is held in place by a plug 21. The aperture 18 from the steam supply pipe 14 leads into an annular groove 22 in the nozzle member 20. Narrow nozzle apertures 23 extend from the annular groove 22 and into the riser 8. In a similar manner the aperture 19 from the pipe loop 11 communicates with an annular groove 24 in the nozzle member 20, and a bore 25 connects the annular groove 24 with a central bore 26 in the nozzle member 20. The bore 26 ends in a constricted nozzle aperture 27, which also leads to the riser 8 near the mouth of the nozzle apertures 23.

During operation steam will be blown into the riser 8 through the nozzles 23 and carry along oil which is fed through the nozzle aperture 27. Since the steam nozzles 23 are inclined relative to the oil nozzle 27, the steam will impinge on the oil jet from the nozzle 27, mixing well with the oil. The mixture of oil and steam will move up through the riser 8 and will be carried at high velocity out through the horizontal nozzle apertures 28 at the upper end of the riser 8. The nozzles (23) for driving agent and the nozzles (27) for fuel are so arrayed in relation to each other in the nozzle member (20) that the driving agent exerts an ejector effect upon the fuel. Thus, the particles in the fluidized bed will not block the apertures 28.

In addition to the advantages already mentioned, the fuel supply system according to the invention makes it possible to obtain very good control of the supplied oil as a result of the built-in constrictions or nozzle apertures 23 and 27 for steam and oil respectively. Each feed point or riser 8 is fitted with a replaceable nozzle member which can easily be replaced from below the constriction plate 1. It will be understood that the oil supply system can be easily adapted to any type of constriction plate. As an example the drawing shows a simple perforated plate, but the system can naturally also be adapted to constriction plates or domes of ceramic material, plates having tuyeres fitted with bubble caps, and other designs. Furthermore, this system can be used for other types of liquid fuels than oil. In various incinerators each riser would preferably be of the same design, but the number of risers and their distribution over the constriction plate may vary depending upon use.

What we claim is:

1. A method for distributing liquid fuel in a fluidized bed incinerator having a constriction plate supporting a fluidized bed of refractory particles, said constriction plate having a plurality of tuyeres therethrough for supplying fluidizing and primary combustion air to said bed from a windbox provided below the constriction plate, comprising the steps of:

forming closed pipe loops through which the liquid fuel circulates below said constriction plate;

extending a plurality of substantially vertical risers through the constriction plate;

supplying pressurized liquid fuel in atomized form to said risers at the lower end thereof by means of fuel nozzles connecting each of said risers to the closed pipe loop;

introducing small quantities of a high pressure gaseous driving agent to the risers at the lower end thereof below the constriction plate through one or more driving agent nozzles associated with each fuel nozzle, said driving agent nozzles being in close proximity to the associated fuel nozzle for intimately admixing said supplied driving agent and said supplied fuel at the lower end of the riser and driving the intimate admixture of driving agent and fuel to the fluidized bed through said riser.

2. The method of claim 1 wherein said gaseous driving agent is steam.

* * * * *